US005262606A

United States Patent [19]

Benson et al.

[11] Patent Number: 5,262,606

[45] Date of Patent: Nov. 16, 1993

[54] SELECTABLE SWITCH ACTION

[75] Inventors: Tony R. Benson, Elk Grove Village; Bruce L. Graham, Schaumburg; John C. Jones, Chicago, all of Ill.

[73] Assignee: Illinois Tool Works Inc., Glenview, Ill.

[21] Appl. No.: 37,434

[22] Filed: Apr. 13, 1987

[51] Int. Cl.[5] ..... H01H 13/56

[52] U.S. Cl. ..... 200/523; 200/524; 200/530; 200/531; 200/536

[58] Field of Search ..... 200/523, 524, 530, 531, 200/536, 292, 510

[56] References Cited

U.S. PATENT DOCUMENTS 3,867,596 2/1975 Schadow ..... 200/523
3,914,570 10/1975 Lockard ..... 200/524
4,404,444 9/1983 Kinney et al. ..... 200/524

*Primary Examiner*—Henry J. Recla
*Assistant Examiner*—David J. Walczak
*Attorney, Agent, or Firm*—Schwartz & Weinrieb

[57] ABSTRACT

A push-button switch is provided which includes a base plate having terminals extending therethrough and solderable in a p.c. board. A housing is subsequently snap-assembled with the base plate and carries a push-button member which is reciprocable when manually pushed. Cam tracks are provided in the housing and a cam follower lever is pivotally mounted on the push-button member. The lever is accessible through an aperture in the housing for engagement with either of the cam tracks. One of the cam tracks produces momentary action, while the other produces alternate action.

20 Claims, 3 Drawing Sheets

SELECTABLE SWITCH ACTION

FIELD OF THE INVENTION

The present invention relates broadly to a push-button switch construction. A push-button switch of the present invention is horizontally mounted on a vertical panel. Present push-button switches mounted on vertical panels generally are mounted on brackets to orient them parallel to printed circuit (P.C.) daughter boards. Alternatively, present-day switches have their leads made stronger than is necessary for other purposes, and bent to provide sufficient support and correct orientation for the switch with regard to a daughter board.

BACKGROUND OF THE INVENTION

A slide switch construction is known in the art in which the switch base and fixed contacts are mounted on a daughter board which is then passed through wave soldering, washing and other operations. Subsequently, a housing incorporating the movable contacts, actuator, light-emitting diodes, and other elements are snap assembled to the switch base so attached to the daughter board. See for example Spedale, U.S. Pat. No. 4,072,839 and Farrell et al. U.S. Pat. No. 4,139,746. However, no one has been successful in adapting such switch construction to a push-button switch.

Push-button switches are known in which the switch action is momentary. That is to say, if the switch is normally off, depressing the push button turns the switch to an on condition. Release of the push-button returns the switch to the off condition. This is sometimes known as momentary switch action. Push-button switches also are known in which the switch connections reverse with each push of the push-button. For example, if the switch is off, depression of the push-button will alter the switch to an on condition which will remain until the push-button is pushed again, whereupon the switch will return to the off position. This is sometimes known as a push-on, push-off switch construction, or alternate action switch.

Efforts heretofore have been made to produce a switch which is optionally a momentary action switch, or an alternate action switch. Such composite switches have required removal or addition of a part to convert from one action to the other, thus requiring a certain mechanical skill on the part of the operator and requiring substantial access room to the switch. For example, see U.S. Pat. Nos. 4,404,444 and 4,427,853. U.S. Pat. No. 4,467,159 also is pertinent and requires a highly complicated switch action.

OBJECTS OF THE PRESENT INVENTION

One object of the present invention is to provide a horizontally-mounted, push-button switch, particularly wherein the switch base and fixed contents are mounted on a daughter p.c. board and soldered, washed, and subjected to other operations prior to assembly of the switch housing, movable contacts, and actuator.

It is a further object of the present invention to provide a push-button switch which is easily selectively set to operate either as a momentary switch or an alternate action switch.

More particularly it is an object of the present invention to provide such a selectively operable switch in which a pair of substantially parallel cam tracks are provided, respectively for producing momentary action or alternate action, and wherein a cam follower is easily manually shiftable from one to the other of such cam tracks.

SUMMARY OF THE INVENTION

In attaining the foregoing and other objects, the present invention provides a switch having a base with fixed contacts and electrical leads extending therefrom. The leads of a plurality of switches are inserted in a daughter p.c. board which is then wave soldered, cleaned, and subjected to other operations. The housing for each switch which carries movable contacts and an actuator is subsequently snapped on to each switch base, and a plurality of daughter boards are assembled with a mother board.

Each switch housing also includes a pair of cam tracks. One of the cam tracks is of a generally heart-shaped configuration generically known in the art for producing an alternate action, that is, push-on, push-off. The other cam track, which is parallel to the first-mentioned track, does not have any retaining portion and is for momentary action. A cam follower is connected to the push-button and is easily user switchable from one track to the other so that the push-button switch will produce either a momentary action or an alternate action.

BRIEF DESCRIPTION OF THE DRAWINGS

The present invention will best be understood from the following specification when taken in connection with the accompanying drawings, in which like reference characters designate like or corresponding parts throughout the several views, and wherein.

DETAILED DESCRIPTION OF THE ILLUSTRATED EMBODIMENT

Figure 1:
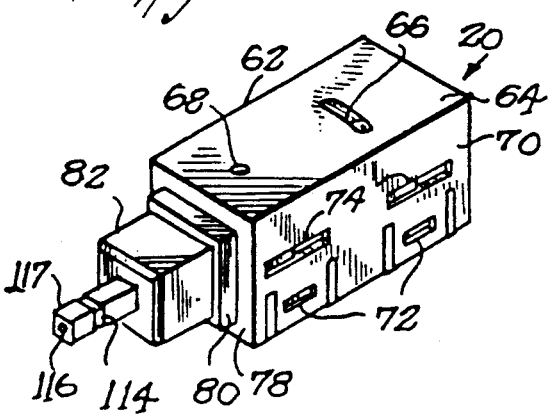
FIG. 1 is a top front perspective view of a selectable action switch constructed in accordance with the principles of the present invention.
Figure 2:
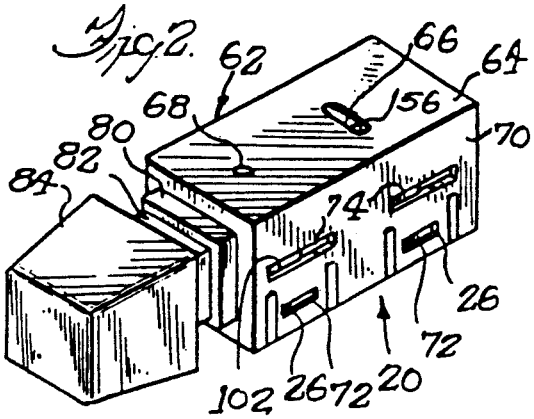
FIG. 2 is a view similar to FIG. 1 with an actuator button applied to the switch.
Figure 3:
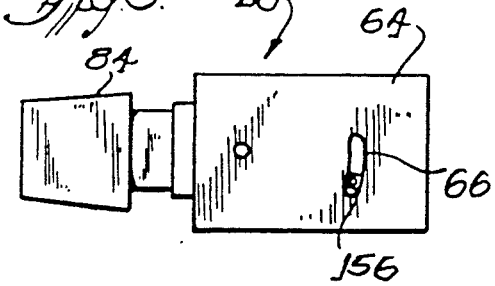
FIG. 3 is a top view of the switch of FIG. 2 on a reduced scale.
Figure 4:
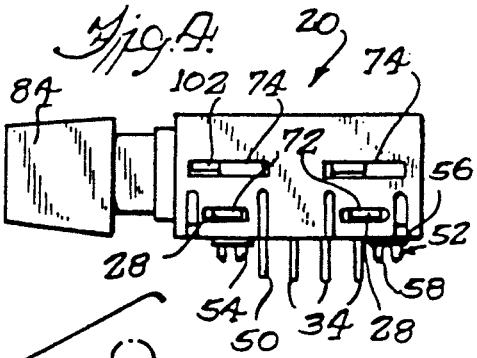
FIG. 4 is a side view.
Figure 5:
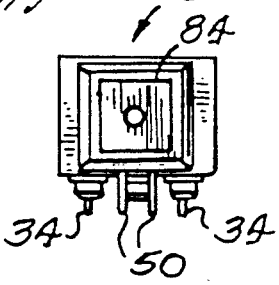
FIG. 5 is a front view.
Figure 6:
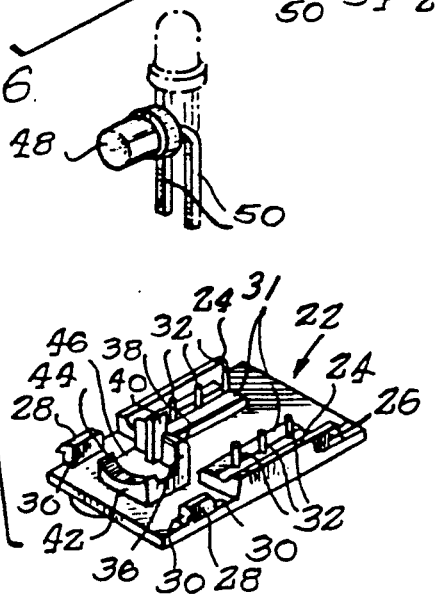
FIG. 6 is an exploded perspective view showing the switch base and contacts, and also a light-emitting diode to be assembled therewith.

A push-button switch 20 constructed in accordance with the principles of the present invention includes a base 22 (FIGS. 6 and 9–11) which comprises substantially a flat plate. Adjacent either longitudinal side thereof are upstanding walls having outwardly directed, wedge-shaped teeth 26. There are additional such teeth 28 on upstanding arms 30 also along the longitudinal edges. The teeth 26 and 28 are spaced relatively adjacent the four corners of the base 22.

Laterally inwardly of the walls 24 are block-like portions 31 from which sets of terminals 32, comprising three along either side, spaced longitudinally of the base, are mounted. The terminals extend upwardly of the blocks 31, and also extend down at 34 below the base plate 22.

Near the left end the base plate 22 is provided with a transverse wall 36 having a length approximately the same as the spacing between the blocks 31. The upper edge of the wall is rounded at 38, and centrally of the wall there is an upstanding separator plate 40 having an upper edge extending above the rounded off upper surface 38 of the transverse wall 36, and having a front edge extending forwardly (to the left) of the wall 36. Forwardly of the wall 36 (to the left) there is provided another transverse wall 42 having an arcuate upper edge 44. A raised floor 46 interconnects the walls 36 and 42.

A light-emitting diode (LED) has a pair of leads 50 that are curved to a right angle adjacent the LED. The free ends of the terminals 50 project down behind the wall 36 and out through openings in the base plate 22. The leads or terminals 50 lie over the top curved edge 38 of the wall 36, and on opposite sides of the upstanding wall 40 which centers the LED, and backs it up, and also spaces the terminals apart. The front part of the LED 48 lies in the arcuate concave upper edge 44 of the wall 42.

Figure 9:
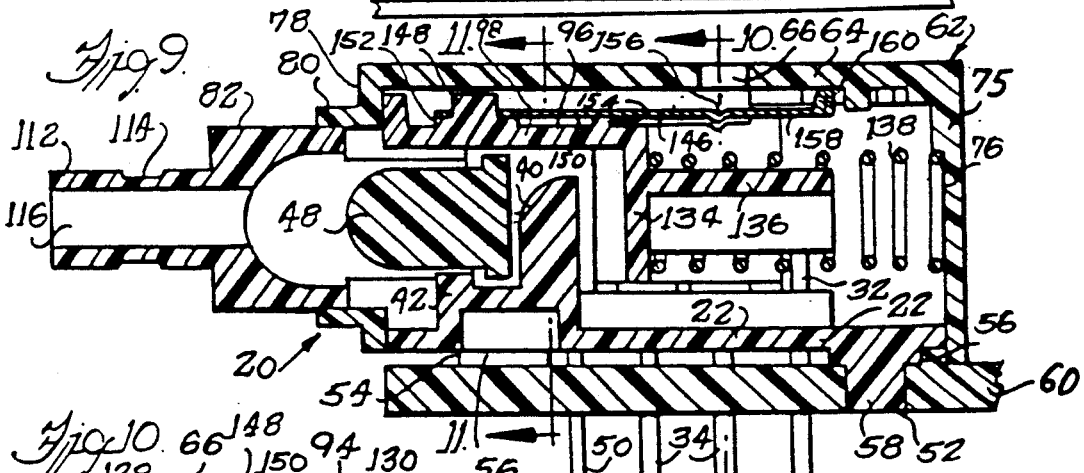
FIG. 9 is a longitudinal sectional view on an enlarged scale taken through the switch of FIG. 1.
Figure 10:
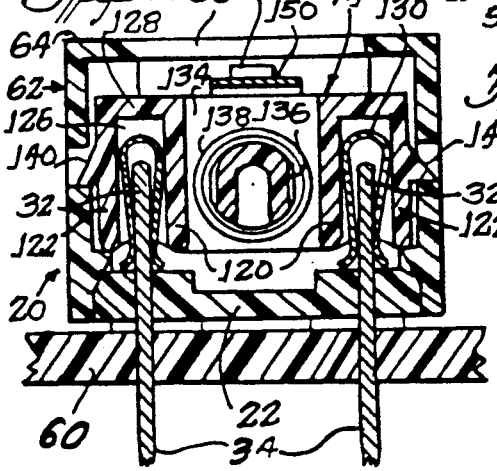
FIG. 10 is a cross-sectional view taken substantially along the line 10—10 in FIG. 9.
Figure 11:
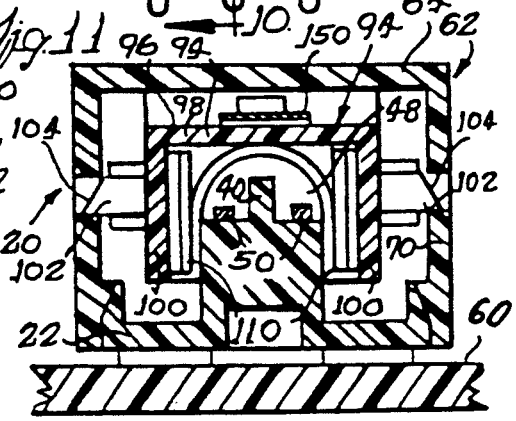
FIG. 11 is a cross-sectional view taken substantially along the line 11—11 in FIG. 9.

The base plate is provided on its underside with a foot 52 adjacent the rear (right) end thereof along the center line, and with a pair of similar feet 54 spaced relatively toward the sides at the front (left) end. Each of the feet 52, 54 includes a cylindrical spacer 56 of shallow height, and an extending cylindrical body 58 preferably split longitudinally and having a tapered entering end. As is seen in FIG. 9, the base plate 22 is assembled with a daughter P.C. (printed circuit) board 60 by inserting the cylindrical bodies 58 of the feet 52, 54 into preformed holes in the P.C. board 60 with the spacers 56 resting against the board. The terminals 34 and 50 extend through preformed parts in the P.C. board 60 and through printed circuit wiring in the board. The board, with the foregoing parts attached, is then subjected to wave soldering, cleaning, and other operations.

The push-button switch 20 further includes a rectangular housing 62 including a rectangular top wall 64 having a transverse arcuate slot 66 therein which comprises an arc of a circle about a center 68. The housing 62 also includes a pair of like rectangular side walls 70 having horizontal slots 72 adjacent the lower corners thereof, and into which the teeth 26 and 28 of the base plate snap when the housing is assembled in the base plate. There are in addition a pair of slots 74 elongated in the direction of the length of the housing 20 and disposed just slightly above the midline. These slots receive further ears to be mentioned later, and slidably mount the structure moved by the push-button. The housing further has a rectangular inner (right) wall 75 which is imperforate and which is provided with a central spring seat 76. The outer (left) end of the housing is closed by a rectangular end wall 78 having a central opening surrounded by a rectangular sleeve 80. A push-button actuator 82 having a push-button 84 thereon extends through the sleeve 80. Connections and operation of the operator 82 will be set forth shortly hereinafter.

Figure 7:
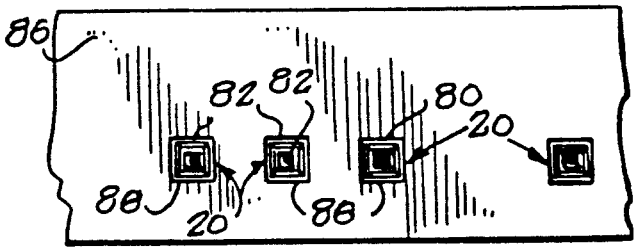
FIG. 7 is a front view of a front panel showing a plurality of switches in accordance with the present invention.
Figure 8:
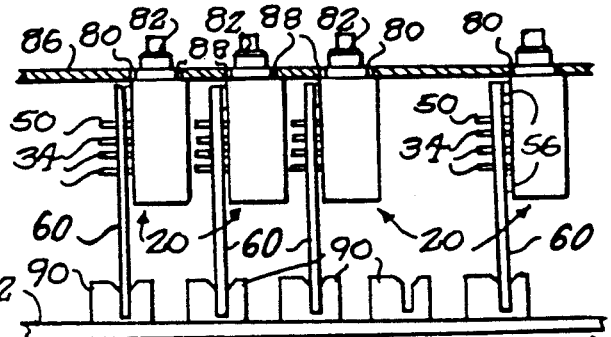
FIG. 8 is a top view corresponding to FIG. 7.

Enough of the structure of the switch has now been set forth for an understanding of how the switch is mounted. With reference to FIGS. 7 and 8, a plurality of switches 20 is mounted horizontally in a horizontal array. To this end, a vertical panel 86 is provided with a horizontal row of substantially square openings 88 in which the sleeves 80 of respective switches are fitted. The printed circuit boards 60 on which the switches are respectively mounted are in vertical position, and each board is received by an array of metallic edge-connectors 90 mounted on an insulating support 92 and which respectively engage the printed circuit wiring on a given board 60. Each push-button switch and the circuit board on which it is mounted are thus securely mounted in a horizontal position.

The push-button operating member 82 is mounted by means to be described hereinafter on a reciprocable member comprising a body 94 of complex shape. The body 94 includes a first or front section 96 comprising a top or horizontal wall 98 and a pair of depending, longitudinal sidewalls 100. The sidewalls are provided with outward projections having sliders, ears or teeth 102 with tapered upper outer surfaces 104 for snapping over the housing walls 70 and into the front pair of slots 74. The projections or teeth 102 are much shorter than the slots 74, whereby the teeth can slide fore and aft in the forward slots 74.

Laterally opposite to the teeth 102 the sidewalls 100 are provided with a pair of ridges 106 (FIG. 12) extending inwardly, and received in corresponding grooves 108 in rearwardly projecting sidewalls 110 of the operating member 82. The operating member 82 is provided with a rectangular forward projection 112 having a peripheral neck 114 intermediate its ends for receipt of cooperating structure (not shown) in the push-button 84 for retaining the push button on the extension 112, and hence on the actuating member 82. The projection 112 is provided with an axial bore 116 which is aligned with the light-emitting diode 48, so that light may extend from this light-emitting diode through the front panel of the push-button, which is transparent or translucent to let the light shine through to indicate an on or off condition of the switch.

Figure 12:
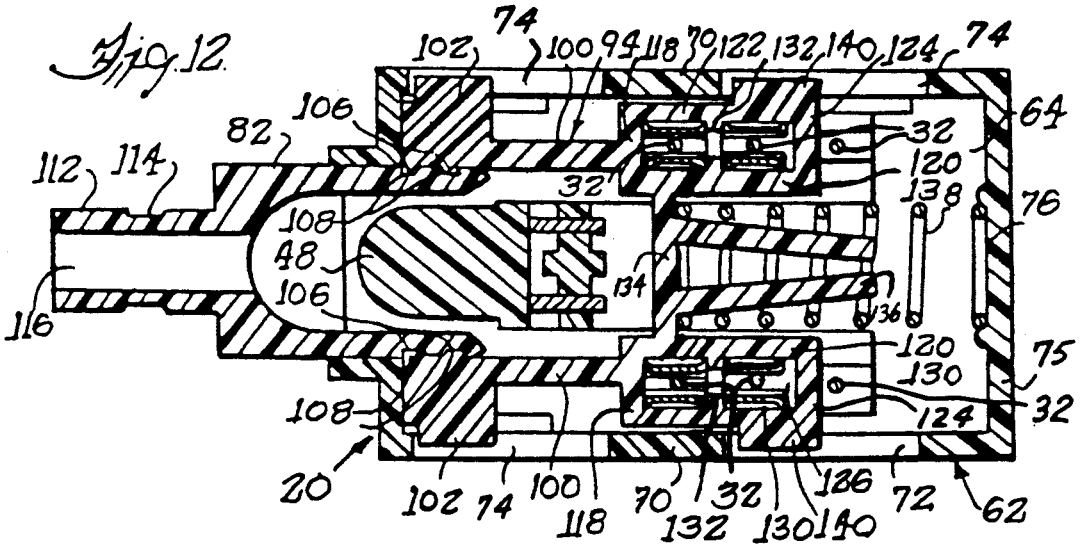
FIG. 12 is a horizontal sectional view through the switch.

The walls 100 terminate at their rear edges at integral, short transverse walls 118, each of which has longitudinally extending, spaced walls 120 and 122. Each pair of walls, 120, 122 is joined at the rear end by terminating transverse walls 124, the sets of walls 118, 120, 122 and 124 defining pockets 126 which open downwardly. Top walls 128 close the pockets at the upper ends. Each pocket encloses a downwardly-opening, substantially U-shaped bridging contact 130, engageable with the central one of the corresponding contacts 32, and either one of the other contacts 32, depending on whether the switch is or is not depressed. The bridging contacts 130 are of conventional construction and are provided with vertical slots in the legs for enhanced flexibility. Inward projections or lands 132 on the walls 120 and 122 fit within the slots in the bridging contact legs as seen in FIG. 12 for enhanced positioning of the bridging contacts.

A central transverse wall 134 extends between the walls 120 relatively near the front (left) ends thereof. A rearward projection 136 which is U-shaped in cross section, and which tapers inwardly from front to back, extends rearwardly from the wall 134. A helical spring 138 encircles the projection 136, being positioned thereby, and seated on the spring seat 76 on the end wall 75 of the housing. The projection 136 serves a dual purpose in that it seats and centers the spring 138, and also provides a limit to how far the push-button can be depressed. To this end the projection 136 is of sufficient length to bottom against the spring seat 76 before any damage can be done to the push-button switch.

Outwardly projecting teeth 140 are provided on the walls 122 near the rear thereof which are similar to the teeth 102 and cam inside the housing sidewalls 70 to snap into the rearward slots 74 to coact with the teeth 102 and forward slots 74 for reciprocal motion of the actuated body 94.

The push-button switch 20 is completed by a pair of cam tracks 142 and 144 formed on the underside of the top wall 64 of the housing, and by a cam follower 146. An integral, upstanding pivot 148 is provided on the body 94 toward the front end thereof, and the cam follower 146 is pivoted thereon. The cam follower includes an elongated body portion 150 spaced above the top of the body 94 by a boss 152 beneath the pivot 148 and a spacer 154 integral with the body 94 and intermediate the cam follower body portion 150. The body portion is provided at its upper end with an indentation 156 accessible from outside of the switch housing 62 through the arcuate slot 66.

The cam follower member 146 is completed by a longitudinally-extending integral arm 158 having an integral upward extension or nib 160 comprising a cam follower.

Figure 13:
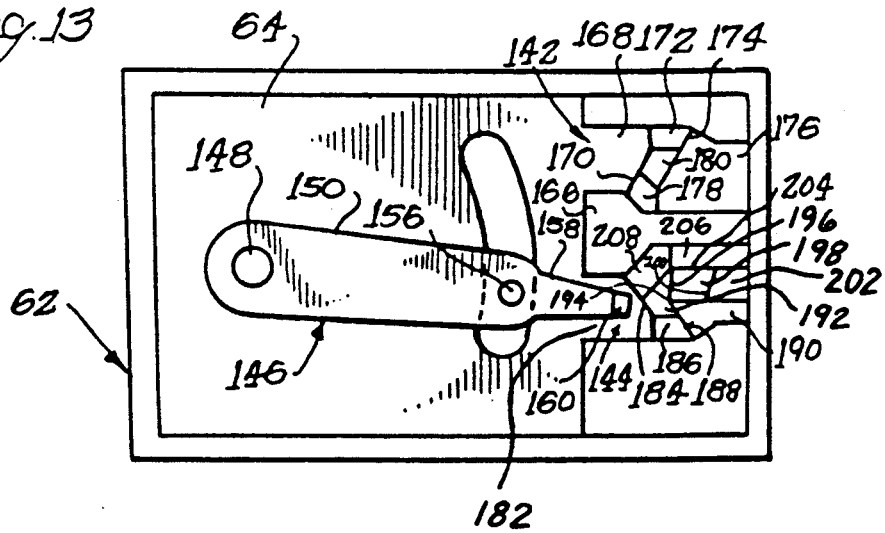
FIG. 13 is a bottom view of the switch housing showing the two cam tracks and the cam follower.

The two cam tracks 142 and 144 are formed in the undersurface of the top wall 64 of the housing 62, as best seen in FIG. 13. The cam tracks are separated by a depending enlargement 166. The first-mentioned cam track, 142, is a momentary cam track. It includes an enlarged entranceway or vestibule 168, having an oblique wall 170, leading to a rising track 172 having the same level at its left or entering end as the vertibule 168, and rising to a drop-off or wall 174. The cam follower member 146 is shown aligned with the second or alternate cam track 144. It is readily movable into the vestibule 168 of the momentary cam track 142 by pushing a pointed article through the slot 66 into the depression 156, thereby to flex the cam follower member downwardly to permit the nib 160 to pass the depending enlargement 166, while the cam follower member is shifted laterally to place the nib 160 in the vestibule 168. A floor 176 is provided beyond the wall 174, and a rising track 178 starts at its right edge, as viewed in FIG. 13, on the same level as the floor 176 and rises to the wall 170. A central island 180 is disposed between the tracks 172 and 174, and forms part of the wall 170 and part of the wall 174. When the push-button 84 is depressed, the reciprocating body 94 is depressed against the spring 138, and the cam follower member 146 is likewise moved to the right. Assuming the nib 160 to be in the vestibule 168, the nib will be deflected by the oblique wall 170 to the track 172, and will move up this track, dropping off of it over the wall 174 to rest on the floor 176. Upon release of the push-button cap 84, parts will move back to the left. The nib 160 will be deflected by the wall 174 until it reaches the track 178, whereupon it will rise up this track and drop over the wall 170.

The second cam track 144 is an alternate action track, that is, push-on, push-off action. This track includes an entrance or vestibule 182 and a diagonal wall 184. The diagonal wall leads to an up-ramp, or path 186, along the right edge. It rises from the level of the vestibule 182 to a drop-off or wall 188. A floor 190 lies beyond the wall 188. The wall 188 continues on to a central block 192 having a central notch 194 and a diverging wall 196 forming a shallow V-shape with the wall 188. An up-ramp 198 extends to the left from the floor 190, and is limited at its far end by a wall 200 on a block 202. The left edge of the up-ramp 198 is terminated by a drop-off or wall 204 leading to a floor 206. This floor, in turn, leads to an up-ramp 208 between the central separater 166 and the intermediate block 192 and leads to the wall 184 previously mentioned.

Accordingly, when the cam follower member 146 is in the position shown in FIG. 13 with the nib 160 in the vestibule 182, a push on the push-button 84 will shift the cam follower member forwardly to cause the nib 160 to be deflected by the wall 184 and hence up the up-ramp 186 to the drop-off wall 188. Release of the push-button cap will cause the spring 138 to move parts in the retracting position, thereby pulling the nib 160 into the notch 194. This holds the switch in the "on" position. A subsequent push on the push-button will cause the nib to act with the diagonal wall 200 and the up-ramp 198 to shift the nib 160 laterally and drop off over the wall 204 onto the floor 206. Release of the push button will then cause the spring to move the cam follower member in a retracting direction, whereby the nib rides up the ramp 208 to drop off over the wall 184 essentially to the starting position.

Cam tracks of the type disclosed are generally known in the art, but to the best of present knowledge, no one has combined alternate action and momentary cam tracks with a cam follower that is pivotable from one to the other manually by readily accessible exterior means. Furthermore, the push-button switch as herein shown and described, is readily mounted in horizontal position without the necessity of accessory brackets or heavy or reinforced terminals.

Of still further importance, the present invention provides a pushbutton switch whereby the switch base and fixed contacts may be mounted upon a substrate which may then be passed through soldering, washing or other operations. The remainder of the switch mechanism is contained in an assembly which may be snap assembled to the switch base, after completion of such operations. Hence, the movable contacts, actuator, light-emitting diode and associated elements need not be subjected to the rigors of such processing.

The specific example of the invention as herein shown and described, is for illustrative purposes only. Various changes will no doubt occur to those skilled in the art and will be understood as forming a part of the present invention insofar as they fall within the spirit and scope of the appended claims.

The invention is claimed as follows:

1. A push-button switch, comprising:

a base;

a plurality of electrical conductors mounted upon said base and comprising contacts on said base;

cover means secured to said base so as to define with said base a housing;

push-button switch means reciprocably mounted within said housing and including an exteriorly accessible manually pushable member and moveable contact means operated by said pushable member and engageable with said electrical contacts of said base;

first means disposed within said housing for defining a momentary contact mode between said moveable contact means of said push-button switch means and said electrical contacts of said base;

second means disposed within said housing for defining an alternate action contact mode between said moveable contact means of said push-button switch means and said electrical contacts of said base; and third means selectively moveable between a first position within said housing at which said third means cooperates with said first means so as to effectuate said momentary contact mode between said moveable contact means of said push-button switch means and said electrical contacts of said base as said push-button switch means moves into and out of said housing, and a second position within said housing at which said third means cooperates with said second means so as to effectuate said alternate action contact mode between said moveable contact means of said push-button switch means and said electrical contacts of said base as said push-button switch means moves into and out of said housing.

2. A push-button switch as set forth in claim 1 wherein said base comprises substantially a flat plate.

3. A push-button switch as set forth in claim 2 wherein each of said electrical conductors comprises a straight element disposed substantially perpendicular to said base plate.

4. A push-button switch as set forth in claim 1 and further including a light-emitting element and a plurality of terminals thereon extending through said base.

5. A push-button switch as set forth in claim 4 and including means on said base supporting said light-emitting element and its terminals.

6. A push-button switch as set forth in claim 1, wherein:

said electrical contacts of said base are disposed substantially in a linear array; and wherein further said moveable contact means of said push-button switch means moves substantially parallel to said linear array.

7. A push-button switch as set forth in claim 6 wherein said electrical contacts of said base are arranged in a plurality of substantially linear arrays, said arrays being substantially parallel to one another.

8. A push-button switch as set forth in claim 1, wherein:

said third means selectively moveable between said first and second positions is mounted upon said push-button switch means for selectively effecting said momentary contact mode or said alternate action contact mode between said moveable contact means of said push-button switch means and said electrical contacts of said base.

9. A push-button switch as set forth in claim 8 wherein said first and second means comprise a pair of cam tracks carried by said cover means, one of said cam tracks being adapted to produce said momentary contact mode and the other being adapted to produce said alternate action contact mode, and wherein said third means on the push-button switch means comprises a cam follower selectively engageable in one or the other of said cam tracks.

10. A push-button switch as set forth in claim 9 wherein said cam follower comprises a lever pivotally mounted on said push-button switch means.

11. A push-button switch as set forth in claim 10 wherein said cover is provided with an aperture through which said cam follower lever is externally accessible for selective movement to one or the other of said cam tracks.

12. A push-button switch selectively actuable for momentary action or alternate action, comprising:

housing means;

fixed contact means mounted within said housing means;

movable contact means movably mounted within said housing means for engagement with said fixed contact means;

push-button means mounted within said housing means and extending exteriorly therefrom for manual actuation by pushing thereon;

means interconnecting said push-button means and said movable contact means for moving said contact means so as to effect engagement of said movable contact means and said fixed contact means;

a pair of control means defined within said housing, one of said control means permitting free movement of said push-button means and said movable contact means such that a momentary action switch operation is achieved as said push-button means is moved into and out of said housing, and another one of said control means arresting movement of said push-button means and said movable contact means such that an alternate action switch operation is achieved as said push-button means is moved into and out of said housing; and means movable between first and second positions within said housing and with respect to one of said pair of control means respectively associated with said first and second positions to alternately effect said momentary or alternate action switch operations.

13. A push-button switch as set forth in claim 12 wherein said pair of control means comprises a pair of cam tracks in said housing, and the means movable between said first and second positions comprises a cam follower movably mounted on said push-button means and selectively engageable with one of said cam tracks, and further including means manually engageable from externally of said housing means for selectively positioning said cam follower in one of said cam tracks.

14. A push-button switch as set forth in claim 13 wherein said cam follower is a lever pivotally mounted on said push-button means and pivotable from one cam track to the other.

15. A push-button switch as set forth in claim 14 wherein said housing means includes an aperture, said cam follower being manually accessible through said aperture for movement from one cam track to the other.

16. A push-button switch as set forth in claim 13 wherein said housing means includes an aperture, said cam follower being manually accessible through said aperture for movement from one cam track to the other.

17. A push-button switch as set forth in claim 13 wherein said housing means has a top wall, and wherein said cam tracks are disposed on the underside of said top wall.

18. A push-button switch as set forth in claim 1, further comprising:

aperture means defined within said cover means; and snap-engaging fastener means disposed upon said base for snap-engagement within said aperture means of said cover means so as to secure said cover means to said base.

19. A push-button switch as set forth in claim 1, wherein:

said electrical conductors mounted upon said base extend through said base so as to be electrically connectible to conductors disposed upon a printed circuit board.

20. A push-button switch as set forth in claim 19, further comprising:

a plurality of feet integrally formed with said base for insertion within apertures of said printed circuit board so as to permit fixed mounting of said push-button switch upon said printed circuit board.

* * * * *